US006810894B2

(12) United States Patent
Chen

(10) Patent No.: US 6,810,894 B2
(45) Date of Patent: Nov. 2, 2004

(54) AUTOMATIC FOLDING UMBRELLA

(76) Inventor: Shiow-Hui Chen, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 10/336,682

(22) Filed: Jan. 6, 2003

(65) Prior Publication Data

US 2004/0129304 A1 Jul. 8, 2004

(51) Int. Cl.[7] ..... A45B 25/00; A45B 24/14

(52) U.S. Cl. ..... 135/22; 135/23; 135/24; 135/25.1

(58) Field of Search ..... 135/22, 23, 24, 135/25.1, 25.4, 75, 20.3, 20.1

(56) References Cited

U.S. PATENT DOCUMENTS 5,224,505 A * 7/1993 Wu ..... 135/24
5,297,571 A * 3/1994 Chu et al. ..... 135/24
5,361,792 A * 11/1994 Lin et al. ..... 135/24
5,533,541 A * 7/1996 Cheng et al. ..... 135/22
5,868,151 A * 2/1999 Kuo ..... 135/24
6,257,257 B1 * 7/2001 Shih ..... 135/24
6,341,613 B1 * 1/2002 Wu et al. ..... 135/24
6,360,759 B1 * 3/2002 Lin et al. ..... 135/24
6,422,250 B1 * 7/2002 Wu et al. ..... 1235/24
6,561,205 B1 * 5/2003 Chen ..... 135/24
6,626,197 B2 * 9/2003 Lin et al. ..... 135/24
2003/0183257 A1 * 10/2003 Lee ..... 135/24

* cited by examiner

*Primary Examiner*—Anita King
*Assistant Examiner*—Amy J. Sterling

(57) ABSTRACT

An automatic folding umbrella is disclosed. Operation of opening and retracting the umbrella is performed by the controlling device installed in the handle, The umbrella comprises of a set of telescopic shafts which includes an upper shaft, a middle shaft and a lower shaft, a notch fixed at the top of the upper shaft, a runner movable along the upper shaft, a pull ring installed on the upper shaft and between the notch and runner, a handle which includes a control device within, fixed at the lower end of the lower shaft, multiple ribs and stretchers connecting the notch and runner, a plurality of expandable springs installed between the notch and the pull ring, a plurality of expandable springs installed between the pull ring and runner, and at least one buckle installed between two shafts

8 Claims, 10 Drawing Sheets

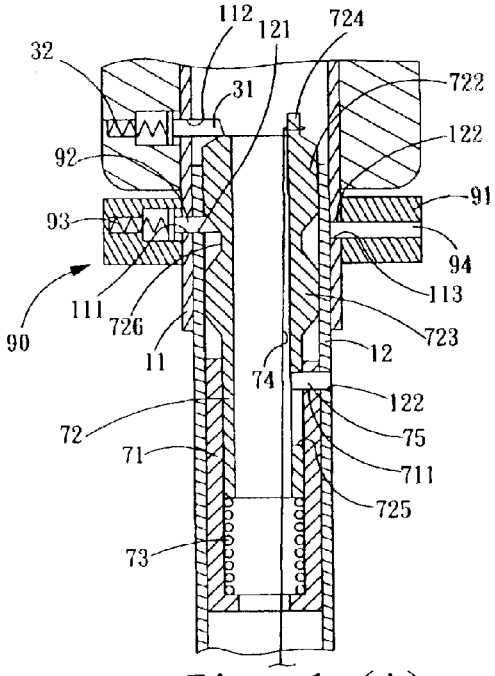
Fig. 1-(A)
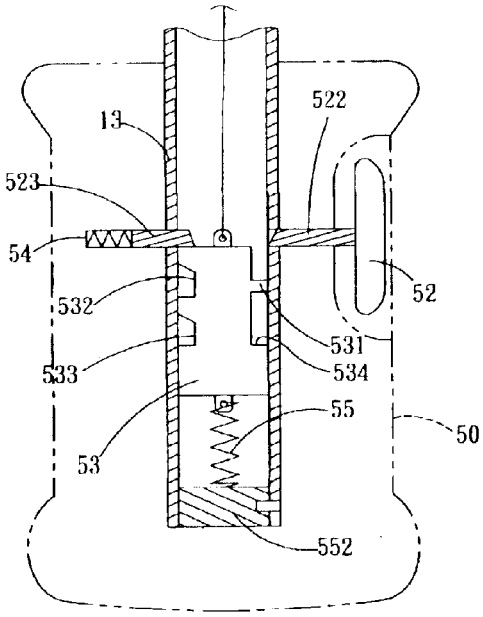
Fig. 1-(B)
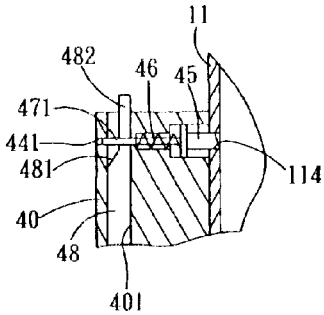
Fig. 1-(C)

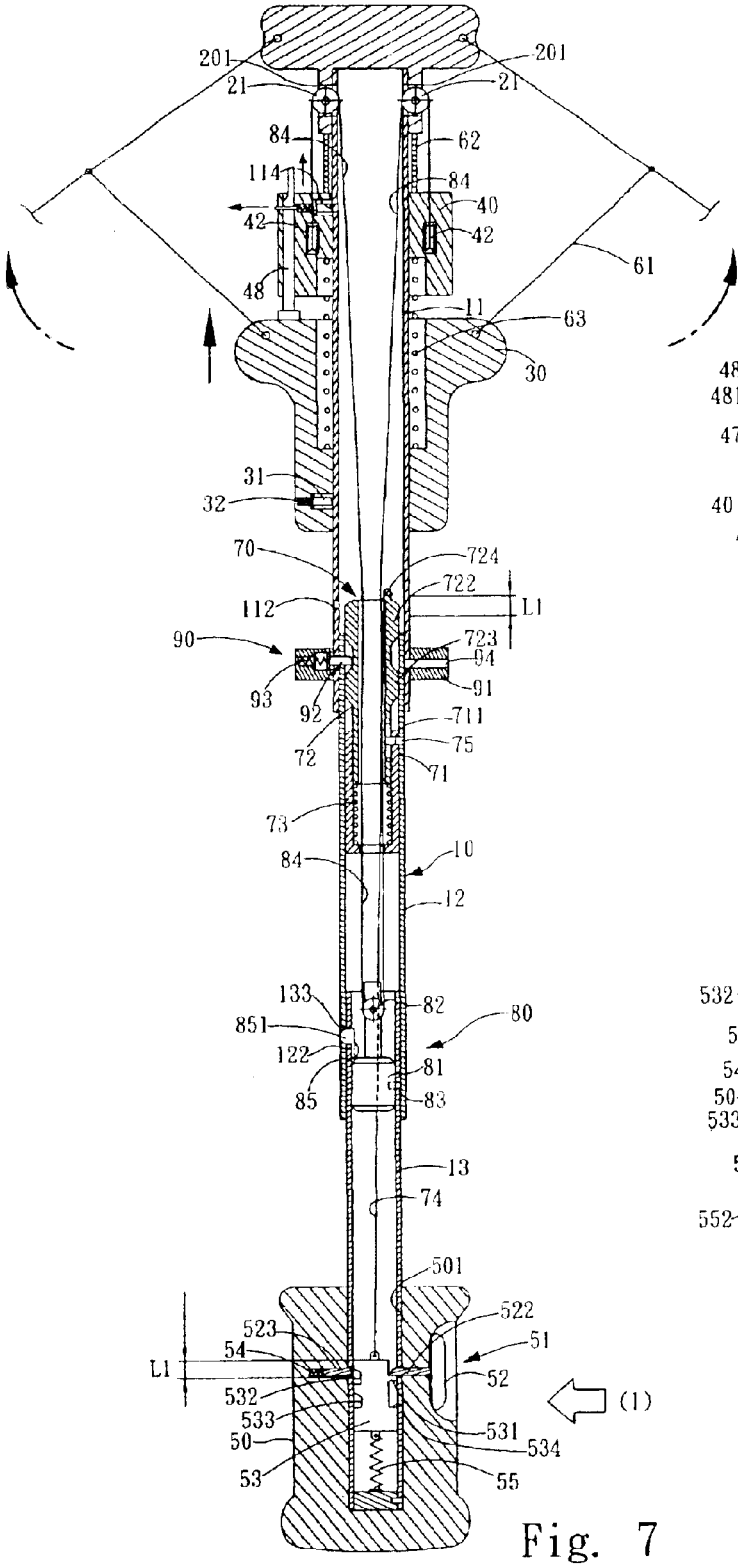
Fig. 7
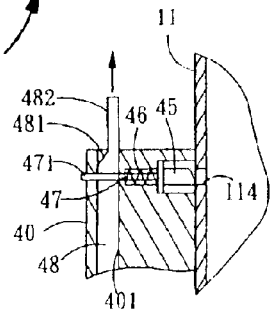
Fig. 7-(A)
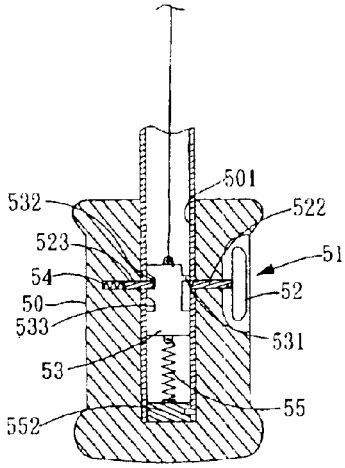
Fig. 7-(B)

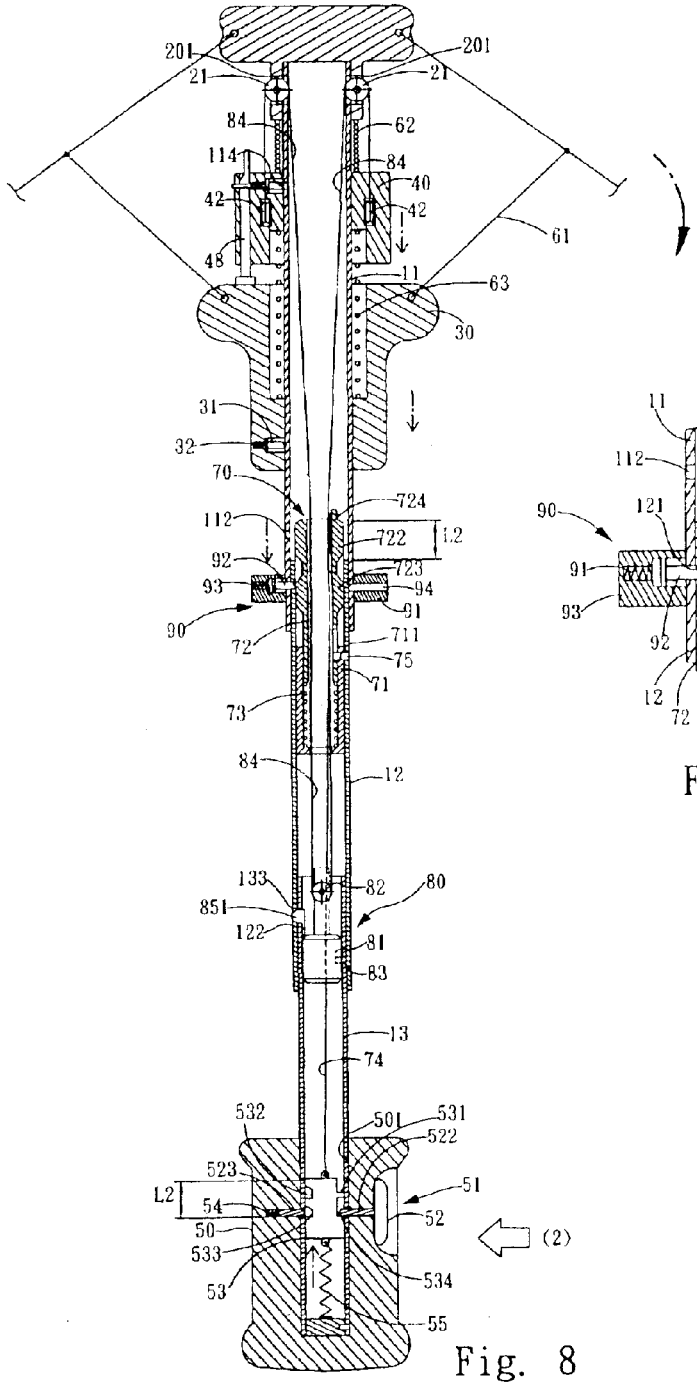
Fig. 8
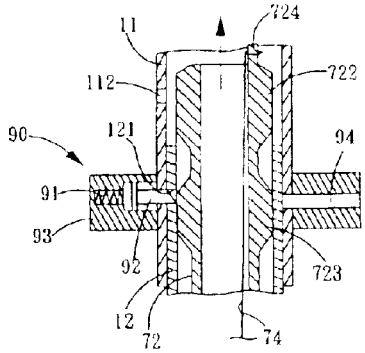
Fig. 8-(A)

AUTOMATIC FOLDING UMBRELLA

FIELD OF THE INVENTION

The mentioned invention relates to umbrellas, and particularly to an automatic folding umbrella. By such invention the umbrella user can easily and conveniently operate the umbrella with only one hand.

BACKGROUND OF THE INVENTION

For conventional automatic umbrellas, the "automatic" mechanism is only applicable when opening the umbrella, and will still require manual operation when retracting and folding the umbrella back to its rest position. In general, there are two types of umbrellas, one is stick umbrellas and the other is folding umbrellas. The stick umbrella can not be folded down and will stay the same shape and size before and after use. The folding umbrella will fully stretch out and open when use, but can be folded down afterwards. Comparing to stick umbrellas, the sizes of the folding umbrellas are about one third of the sizes of the sick umbrellas at the resting position, and thus does not occupy as much space.

Even though the folding umbrella provides some advantage over stick umbrella, it will still require two hands to retract and fold-down the umbrella. Such requirement has proven to be very inconvenient and troublesome when the user is operating the folding umbrella while carrying objects in hand at the same time. The user simply does not have both hands free and available to successfully operate the folding umbrella. Such circumstance can be very difficult and frustrating when carrying objects in hand while entering a car or indoor in a raining day.

Thereby, an automatic folding umbrella is developed such that the umbrella can be opened up and folded back automatically. However the current automatic folding umbrella mechanism can only close in the umbrella cover and ribs while the umbrella shafts (multiple shafts) are still extended. It will require manual operation of pressing down the multiple shafts so that the umbrella can be completely retracted back to its original resting position. If such step is not taken to restore the umbrella back to its original resting position, the automatic mechanism will lose its ability to perform the "automatic opening" function in next usage. Thus, this design only posses ability to "auto" open, but "semi auto" close. It will still require manual operation to finish up the umbrella retracting step to full restore the umbrella back to its original resting position.

Based on the above mentioned facts, the objective of this invention is such that with single hand operation, one is capable of complete the cycle of operating an automatic umbrella from its resting position to the opening position, then retracting the open umbrella back to its original rest position.

SUMMARY OF THE INVENTION

The first objective of this invention is to provide a fully automatic folding umbrella. With single hand operation, one is capable of completing the cycle of operating an automatic umbrella from a rest position to an opening position, then retracting the open umbrella back to its original rest position. At the umbrella open position, the fully connected and extended multiple umbrella shafts can be retracted back to the size and position of single shaft. A push and brake device installed at the upper end of the middle shaft. The push and brake device includes a sleeve in the middle shaft. A push rod is in the sleeve, having an upper tapered head and a lower tapered head. An expandable spring is in the sleeve for ejecting the push rod. A pull line is installed between the push rod and a brake block of the control device. A buckle has a buckle ring at the lower end of the upper shaft buckle stud and an expandable spring are in the inner hole of buckle ring, wherein after the buckle stud passes through the holes of the upper shaft and the middle shaft, and then inserts into a guide groove in the push rod and between an upper tapered head and a lower tapered head.

The second objective of this invention is to provide a fully automatic folding umbrella. A special control device installed in the handle enables the user at the push of button on the umbrella handle, in a two-step procedure, to open and retract the umbrella. The umbrella will be fully retracted back to its original rest position without additional manual assistance. The control device in the handle includes a button at a groove of the handle, a brake block in the lower shaft, a spring installed in a guided groove of the handle for pushing the button backwards, and a contractible spring at a lower end of the brake block. The inner side of the button has a control ring passing through a radial groove. When the lower shaft passes through the axial straight hole of the handle, the control ring encloses a periphery of the lower shaft, and a front stopper and a rear stopper on the inner wall of the control ring passes through the two corresponding holes of the lower shaft. The rear stopper resists against an upper end of the brake block.

The third objective of this invention is to provide a fully automatic folding umbrella. A buckle serves for connecting the middle shaft and the lower shaft. The buckle includes a post stud installed in the lower shaft and a pulley installed in a post rod at the upper end of the post stud. An inserting stud for fixing the post stud to the lower shaft, and an elastic buckle piece is installed at the wall of the post stud. The inserting stud passes through a hole in the lower shaft, and then in inserted into the hole of the post stud. The pulley is a turning point of the pull line, and elastic buckling piece has a bead. The bead is buckled into the holes of the middle shaft and lower shaft.

BRIEF DESCRIPTION OF THE DRAWINGS

FIG. 1A is a schematic view showing the push rod and the buckle stud of FIG. 1

FIG. 1B is a schematic view of umbrella handle showing the engagement of the brake block and the control device.

FIG. 1C shows the of buckle stud for the pull-ring at lock-in position with the upper shaft

FIG. 7 is a schematic view showing the umbrella at open position after first release of the handle push-button.

FIG. 7A is a schematic view showing the buckle stud for the pull-ring at release position with the upper shaft.

FIG. 7B is a schematic view showing the operation of the handle after the first release of the handle push-button.

FIG. 8 is a schematic view showing the position of the umbrella after the second release of the handle push-button.

FIG. 8A is a schematic view showing that the buckle stud in FIG. 8 is released from the middle shaft

DETAILED DESCRIPTION OF THE PRESENT INVENTION

The Invention will be Described in Detail Below

Figure 1:
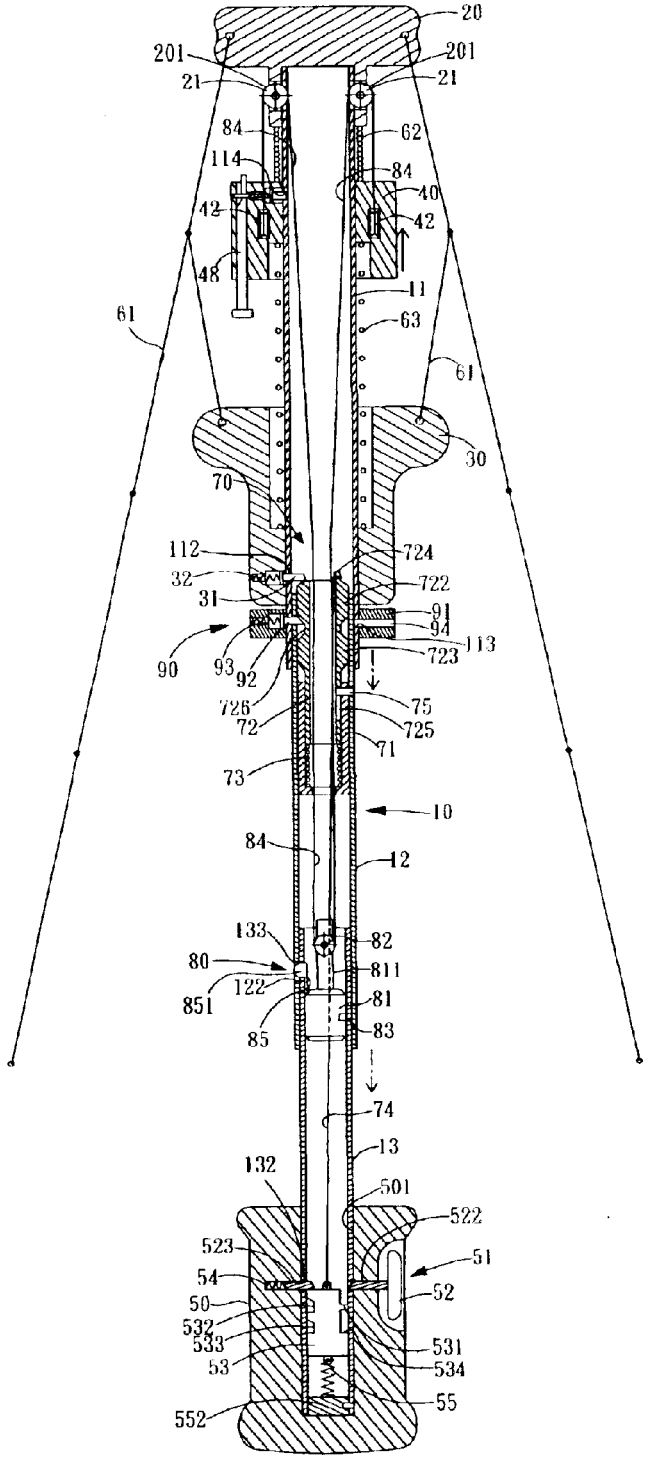
FIG.1 is a schematic cross sectional view showing that in the present invention the umbrella cover and ribs are folded in, the multiple shafts are stretched-out.

With reference to FIG. 1, the cross section view showing that in the present invention, the umbrella cover and ribs are folded in, the multiple shafts are stretched-out. The multiple set of shafts 10 umbrella comprises a middle shaft 12, an upper shaft 11 on a top of middle shaft 12, and a runner 30 moveable along an upper shaft 11; a pull-ring 40 positioned among the upper shaft 11, a notch 20, a runner 30, a handle 50 at a lower end of lower shaft 13; and an umbrella rib and a stretcher 61 connecting notch 20 and runner 30. The umbrella rib and stretcher 61 is the main construction in support of the umbrella cover. A set of expandable spring is positioned on the upper shaft 11 and between the notch 20 and a pull-ring 40, and a contractible spring 63 is installed on the upper shaft 11 and is installed between the pull-string 40 and the runner 30. In the drawing, the multiple set of shafts 10 is assembled by an upper shaft 11, a middle shaft 12 and a lower shaft 13. The number of shafts is not confined by this embodiment; the number of shafts may be 2, 4 or more.

A buckle 90 is mounted between the upper and middle shafts 11 and 12, and another buckle 80 is mounted between the middle and lower shafts 12 and 13. The handle 50 has a push button controlling device 51 for opening and closing the umbrella. A push and brake device 70 is mounted inside the middle shaft 12 where it joins the upper shaft 11.

Figure 2:
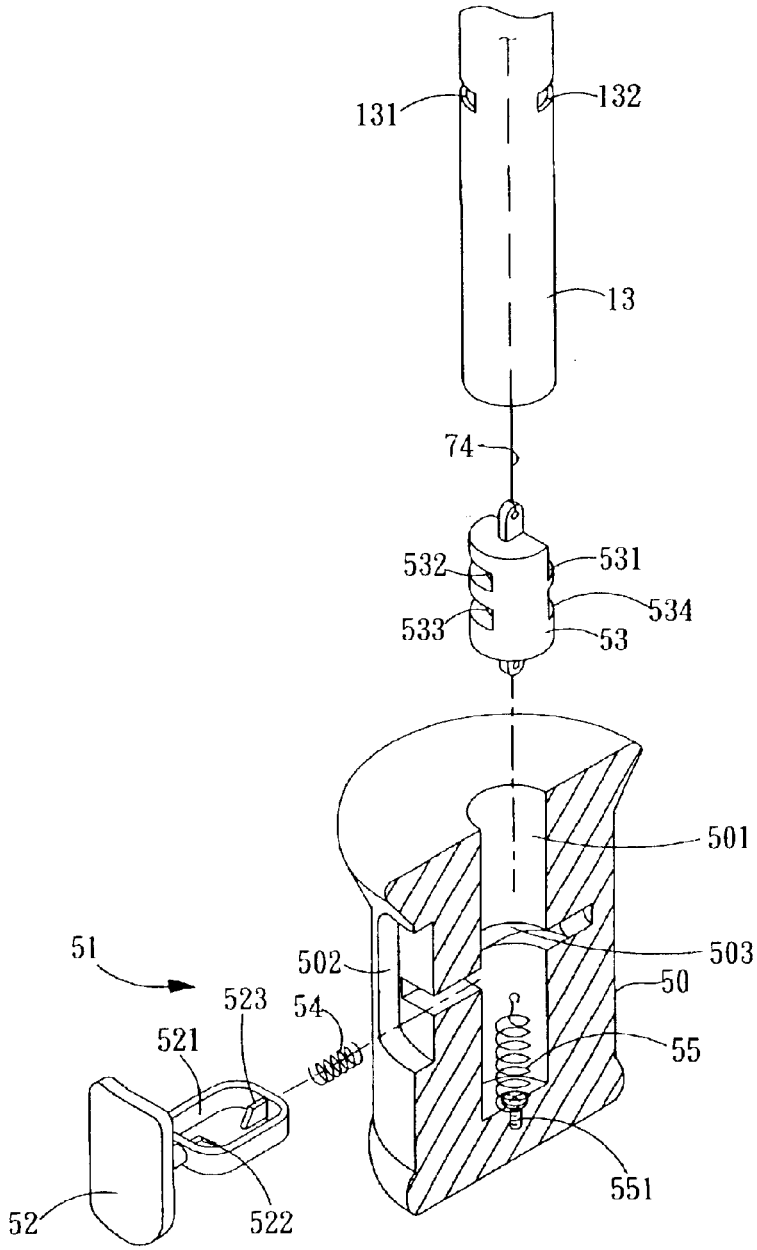
FIG. 2 is a prospective view of drawing on the handle and brake block.

In reference to FIG. 1B and FIG. 2, the control device 51 is installed in the umbrella handle 50 and constitutes of push-button 52 in the handle groove 502, a brake block 53 at the lower shaft 13, a spring 54 installed in a handle guide groove 503 for pushing back the push-button 52, and a contractible spring 55 underneath the brake block 53. Connecting to the push-button 52 is a control ring 521 that passes through the groove area 503. When the lower shaft 13 penetrates through the straight hole 501 in handle 50, the control ring 521 will embrace the lower shaft 13, and two symmetrical front stopper 522 and rear stopper 523 in the control ring 521 will pass through the two corresponding holes 131, 132 at the lower shaft 13. The rear stopper 523 will resist against the upper side of brake block 53. In addition, the bottom of the brake block 53 is pulled down by a contractible spring 55. The other end of the contractible spring 55 is fixed to the bottom end of lower shaft 13. As shown in FIG. 2 and FIG. 1B, the contractible spring 55 is fixed to block 552 by the screw 551. The top of the brake block 53 is hooked up and pulled by a pull line 74 at a fixed length. The upper end of pull line 74 is fixed to a push rod 72 of a push and brake device 70. On the side of brake block 53 facing the button 52 is a first protruding block 531, and a second protruding block 534. Another end of the brake block 53 facing the button 52 is installed with a first receiving groove 532, and a second receiving groove 533. The height of the first protruding block 531 is lower then that of the first receiving groove 532, but higher than that of the second receiving groove 533.

Figure 3:
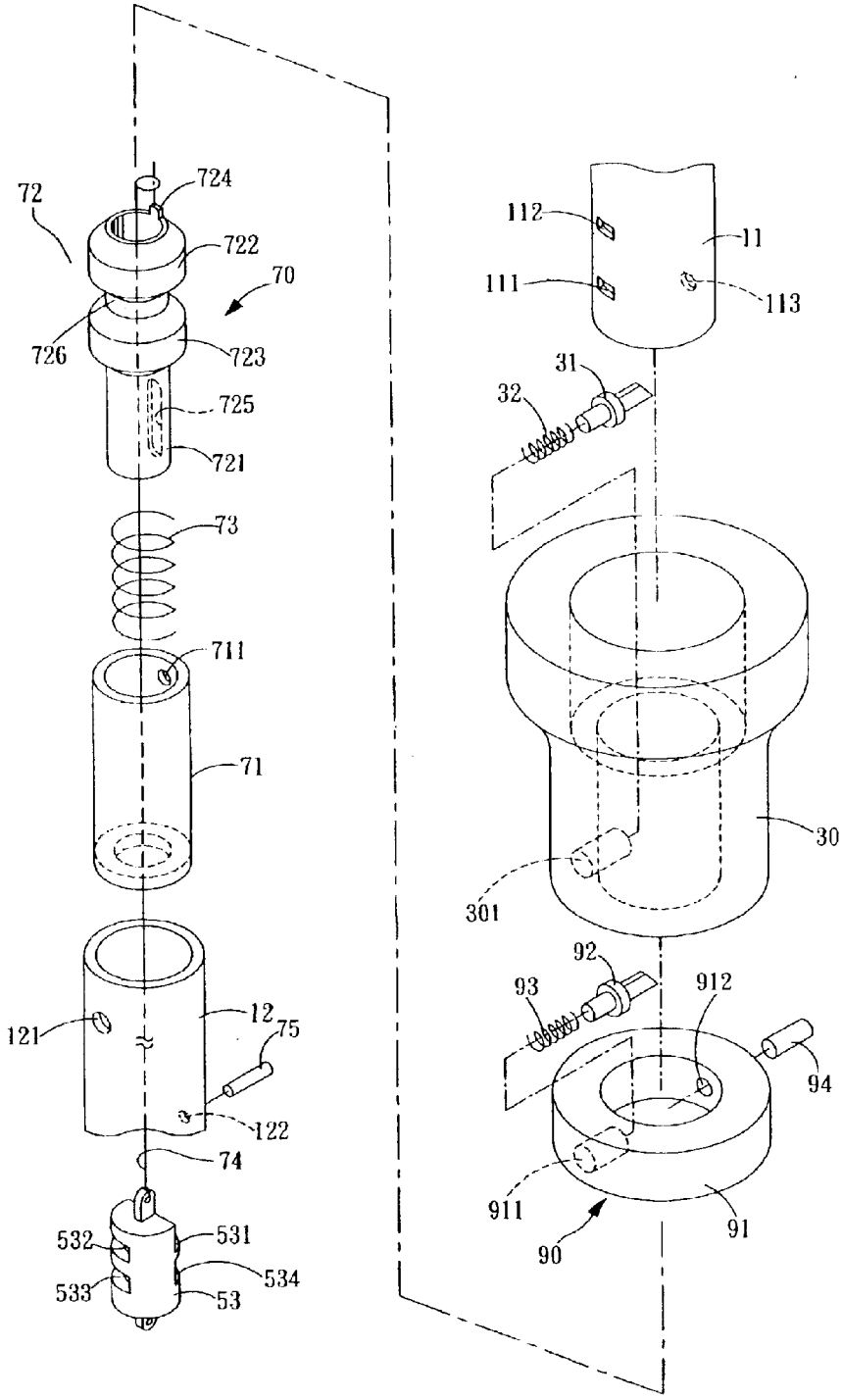
FIG. 3 is a prospective view of drawing on the pull-ring, buckles and push-and-brake device.

As shown in the FIGS. 1A and 3, an inner upper end of the middle shaft 12 is installed with a push and brake device 70 (referring to left side view of FIG. 3). The push and brake device 70 includes a sleeve 71 in the middle shaft 12, a push rod 72 in the sleeve 71, an expandable spring 73 installed in the sleeve 71 for ejecting the push rod 72 and a pull line 74 hung between the push rod 72 and the brake block 53.

The push rod 72 is a round tube 721 with an upper tapered head 722 and a lower tapered head 723. Diameters of the upper tapered head 722 and lower tapered head 723 are larger than that of the sleeve 71. A top of the tapered head 722 serves for fixing the pull line 74. A protruding block 724 can be installed. A long slot 725 on a wall of the round tube 721 is matched and coupled to the though holes 711 of the sleeve 71 and the though hole 122 on the wall of the middle shaft 12 for being inserted by a stud 75. Therefore, the sleeve 71 is fixed to the middle shaft 12. The push rod 72 resists against the stud 75 by the long slot 725 so that it only moves along a predetermined distance and cannot rotate leftwards or rightwards.

Referring to FIGS. 1 and 3, the buckle 90 serves to fix the upper shaft 11 and middle shaft 12. As the right side view of the drawing, the buckle 90 is positioned below the lower cell 30. The buckle 90 includes a buckling ring 91 at a lower end of the upper shaft 11, a buckle stud 92 and an expandable spring 62 in an inner hole 911 of the buckling ring 91. An insert stud 94 passes through the though hole 912 and then through the positioning hole 113 of the upper shaft 11 so that the buckling ring 91 is fixed. The buckle stud 92 passes through the though holes 111, 121 of the upper shaft 11 and middle shaft 12 (referring to FIG. 1A), and then through the guide groove 726 between the upper tapered head and lower tapered head. Next, an inner hole 301 at a lower end of the lower cell 30 has a buckle stud 31 and an expandable spring 32. The buckle stud 31 passes through the though hole 112 the upper shaft 11 (referring to FIG. 1A) to resist against a top end of the upper tapered head of the push rod 72.

Figure 4:
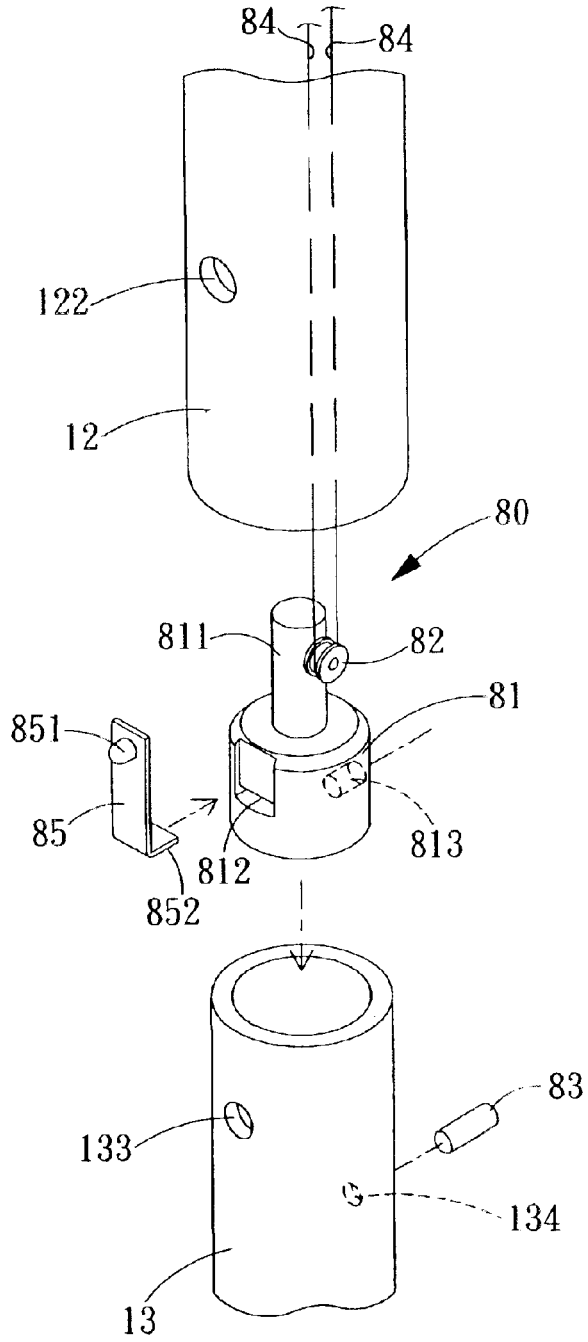
FIG. 4 is a prospective view of drawing on the join-buckle between an upper shaft and an middle shaft of the present invention.

With reference to FIGS. 1 and 4, a buckle piece 80 serves to fix the middle shaft 12 and lower shaft 13. The buckle 80 includes an inserting stud 83 fixed in the lower shaft 13 and an elastic buckle 85 at a wall of the post stud 81, a pulley 82 at the post 811 at an upper end of the post stud 81, an inserting stud 83 for fixing the post stud 81 at the lower shaft 13; and an elastic buckle piece 85 installed on an wall of the post stud 81. The inserting stud 83 passes through the though hole 134 of the lower shaft 13 and then inserts into an embedding hole 813 of the post stud 81. The pulley 82 is a turning point of the pull line 84. Upper ends of the two pull lines 84 passing through the pulley pass through the right and left pulleys 21 at a top of the upper shaft 11 and then are guided into the pull ring 40 to wind around the two winding wheels 42. When the upper shaft 11, middle shaft 12 and lower shaft 13 expand completely, the pull lines 84 are tightly extended. By the pull lines 84, the pull ring 40 can be pulled upwards to a top of the upper shaft 11. On the contrary, when the upper shaft 11, middle shaft 12 and lower shaft 13 are contracted, the pull lines 84 are loosed. The pull ring 40 will descend due to the releasing effect of the top expandable spring 62 (this will be described further in the following). A lower inserting piece 852 of the elastic buckle piece 85 is inserted into an inserting opening 812 of the post stud 81. An bead 851 at an upper end of the elastic buckle piece 85 can be buckled into a though hole 133 at an upper end of the upper shaft 11 and then embeds into the though hole 122 of the middle shaft 12 so that the middle shaft 12 and lower shaft 13 are buckled with one another. On the contrary, if the beads do not embed into the lower though hole 122 of the middle shaft 12, the middle shaft 12 and lower shaft 13 will release from one another.

Figure 5:
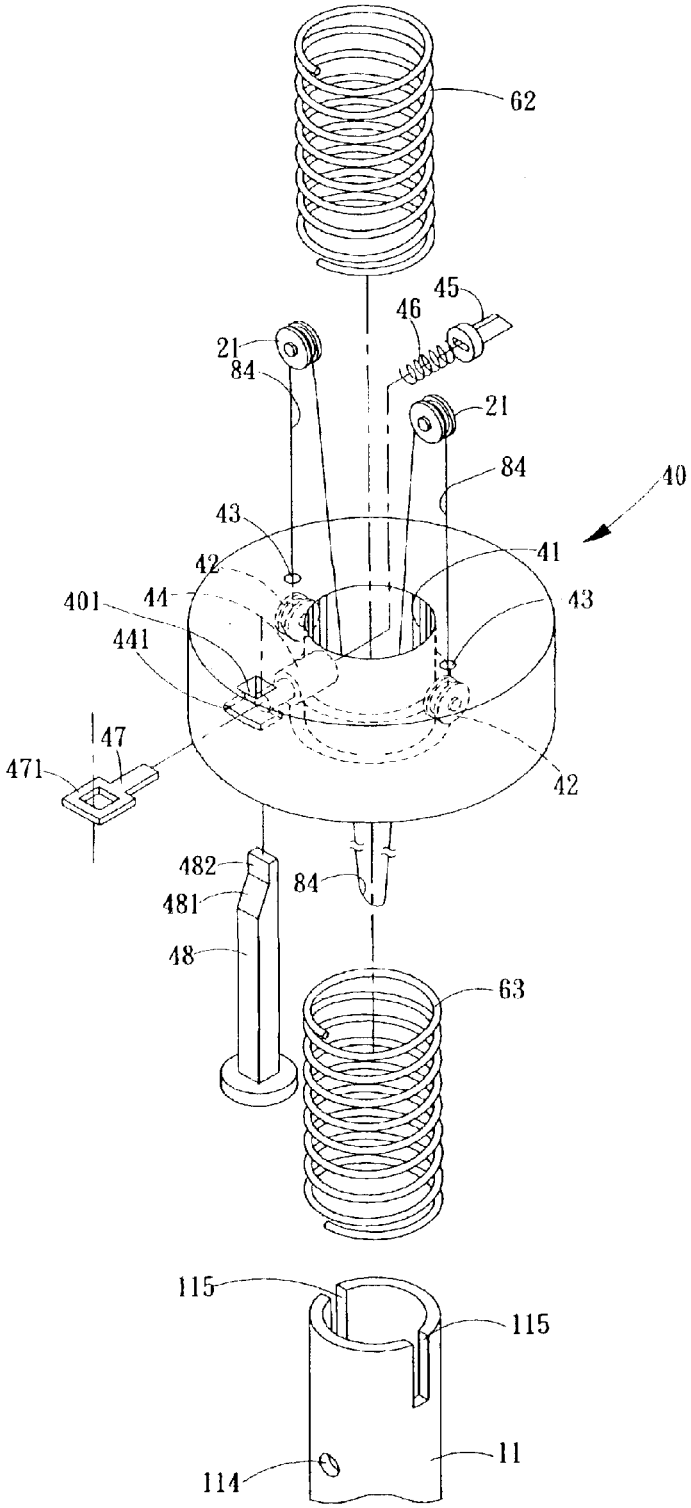
FIG. 5 is a prospective view of drawing on the construction of upper shaft and pull-ring of the present invention.

Referring to FIGS. 1 and 5, a center of the pull ring 40 at an upper end of the upper shaft 11 has a slot 41 for being passed through by the upper shaft 11. Two sides inside the slot 41 each have respective winding wheels 84 for winding the pull lines 84. The pull line 84 passes out of the line holes 43 at a top surface of the pull ring 40, and then winds through the pulleys 21 in the notches 201 of the upper cells 20, then the pull lines 84 pass through the two symmetrical notches 115 at a top of the upper shaft 11; and then extends downwards to wind around the pulley 82 of the buckle 80. When the middle rods 11 to 13 are expanded, the pull lines 84 are tightened. When the pulley 82 rises, the pull line looses so that the pull ring 40 descends due to the expansion of the expandable springs 62. On the contrary, when the pulley 82 descends to a predetermined position (referring to FIG. 1), the pull line 84 tightens so that the pull ring 40 pulls upwards until the buckle stud 45 is embedded into a though hole 114 of the upper shaft 11 (referring to FIG. 1C). The springs 62 are pressed by the pull ring 40 and thus compresses. A lateral wall of the pull ring 40 is formed with a though hole 44 for receiving the buckle stud 45 and the expandable spring 46. A rear end of the buckle stud 45 is combined with an inserting rod 47. The inserting rod 47 inserts into the inserting opening 441. The inserting opening 441 is communicated with the though hole 44. Another axial though hole 401 is communicated with the radial inserting opening 441. The though hole 401 may be inserted by a passing rod 48 from an upper side thereof. A top of this passing rod 48 has a wedge surface 481 and a thin rod 482. The thin rod 482 can insert into an annular opening 471 of the inserting rod 47. When the wedge surface 481 moves upwards or descends, the inserting rod 47 moves laterally to enforce the buckle stud 45 moves. When the buckle stud 45 is buckled into the though hole 114 at the top of the upper shaft 11, the pull ring 40 will fix to the upper shaft 11 without separation. If the buckle stud 45 separates from the though hole 114, the pull ring 40 is separated from the upper shaft 11.

Figure 6:
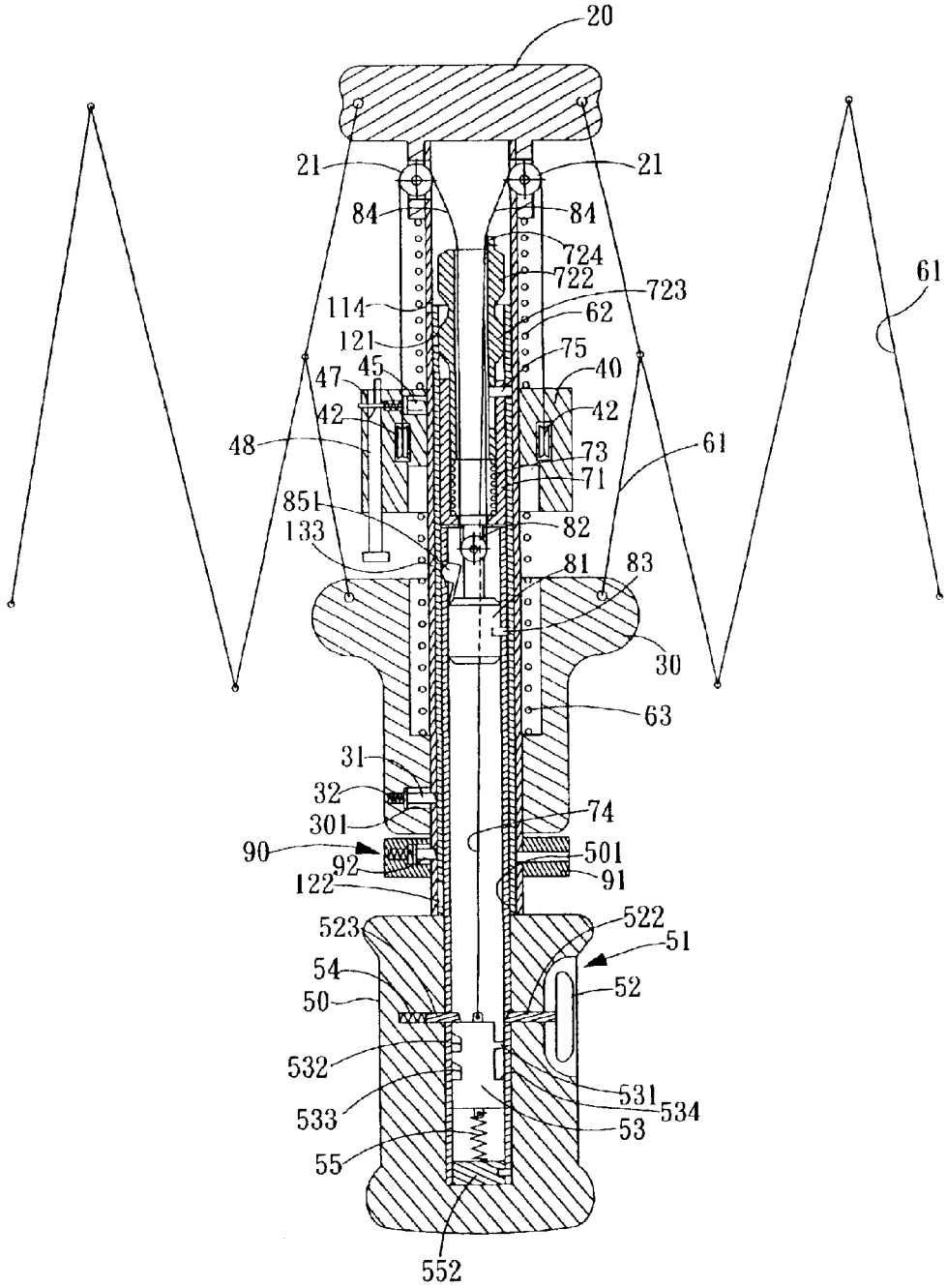
FIG. 6 is a cross section view of the umbrella retracted and folded at its rest position according to the present invention.

The expansion process of the present invention is illustrated in FIG. 6. In FIG. 6, the umbrella is folded for storage before expansion. The set of shafts 10 is contracted as a single section, when it is desired to expand the umbrella, the middle rods 11 to 13 of the set of shafts 10 are extended manually, as illustrated in FIG. 1. Since the upper shaft 11 and middle shaft 12 are fixed by the buckle 90, and the middle shaft 12 and the lower shaft 13 are fixed by the buckle 80, after expansion, the upper shaft 11, middle shaft 12 and upper shaft 11 are positioned and do not contract. When the lower shaft 13 extends backwards, the pulley 82 at the top of the lower shaft 13 rises by the two pull lines 84 so as to pull the pull ring 40 until the buckle stud 45 moves upwards and then buckled into the though hole 114 of the upper shaft 11 and is buckled therein. Then, a buckle stud 31 at a lower end of the lower cell 30 will be ejects by spring 32 so as to be buckled into the though hole 112 near a lower end of the upper shaft 11 to resist the rising of the push rod 72. Besides, after the upper shaft 11 moves to an upper end of the middle shaft 12, the buckle stud 91 for buckling the buckle 90 will be buckled into the though hole 121.

Referring to FIG. 7, when the user presses the button 52 of the handle 50 first time, the stopper 523 reduces so that the brake block 53 is not hindered and thus can rise upwards. When the raised brake block 53 is hindered by the front stopper 522 at the lateral side of the first protruding block 531, it will not rise again. Therefore, the brake block 53 only rises through a distance of L1. Since the brake block 53 rises through a distance of L1, the push rod 72 also rises with a distance of L1. However, at this time, the upper tapered head 722 will press the buckle stud 31 so as to reduce outwards to separate from the though hole 112. Therefore, the lower cell 30 is not be fixed to a lower end of the upper shaft 11. On the contrary, it is pulled by the compressed spring 63. When it rises to the top to touch the pass rod 48 so that after the pass rod 48 (referring to FIG. 7A) rises, the inserting rod 47 will move outwards and the buckle stud 45 separates from the though hole 114. Thereby, the pull ring 40 is not fixed the upper end of the upper shaft 11. Although the lower cell 30 and pull ring 40 are not combined to the upper shaft 11, and the middle rods 11 to 13 are fixed by the buckles 80 and 90, the lower cell 30 and pull ring 40 can not descend. Since the bones 61 and umbrella cloth are expands, the user can use the umbrella to shield rain or sunshine.

With reference to FIG. 7B, when the finger release the button 52, the button 52 will restore by the expansion of the spring 54 and thus the front stopper 522 reduces inwards and the brake block 53 rises slightly until the protruded rear stopper 523 moves to the first receiving groove 532, while the brake block 53 does not rise again.

Referring to FIG. 8, when the umbrella is to be folded, the user presses the button 52 twice, and then the rear stopper 523 reduces so that the brake block 53 dose not be hindered. When the raised brake block 53 does not rise since the second protruding block 534 is hindered by the front stopper 522. Therefore, the brake block 53 rises through a distance of L2. On the contrary, after the pull line 74 releases, the push rod 72 is pushed by the spring 73 to rise through a distance of L2. However, at this time, the lower tapered head 723 will press the buckle stud 92 to reduce outwards and thus not to pass through the though hole 121 (referring to FIG. 8A). Then the upper shaft 11 and middle shaft 12 does not be buckled and thus the two can be separated at any time. When the middle shaft 12 reduces into the upper shaft 11, the pull lines 84 will loose so that the expandable springs 62 extend. The tensions from the extension of the expandable springs 62 are larger than the elastic force of the contractible spring 63 so as to enforce the pull ring 40 and lower cell 30 descends. Thus the upper shaft 11 descends therewith. The middle shaft 12 reduces into the upper shaft 11 continuously.

Figure 9:
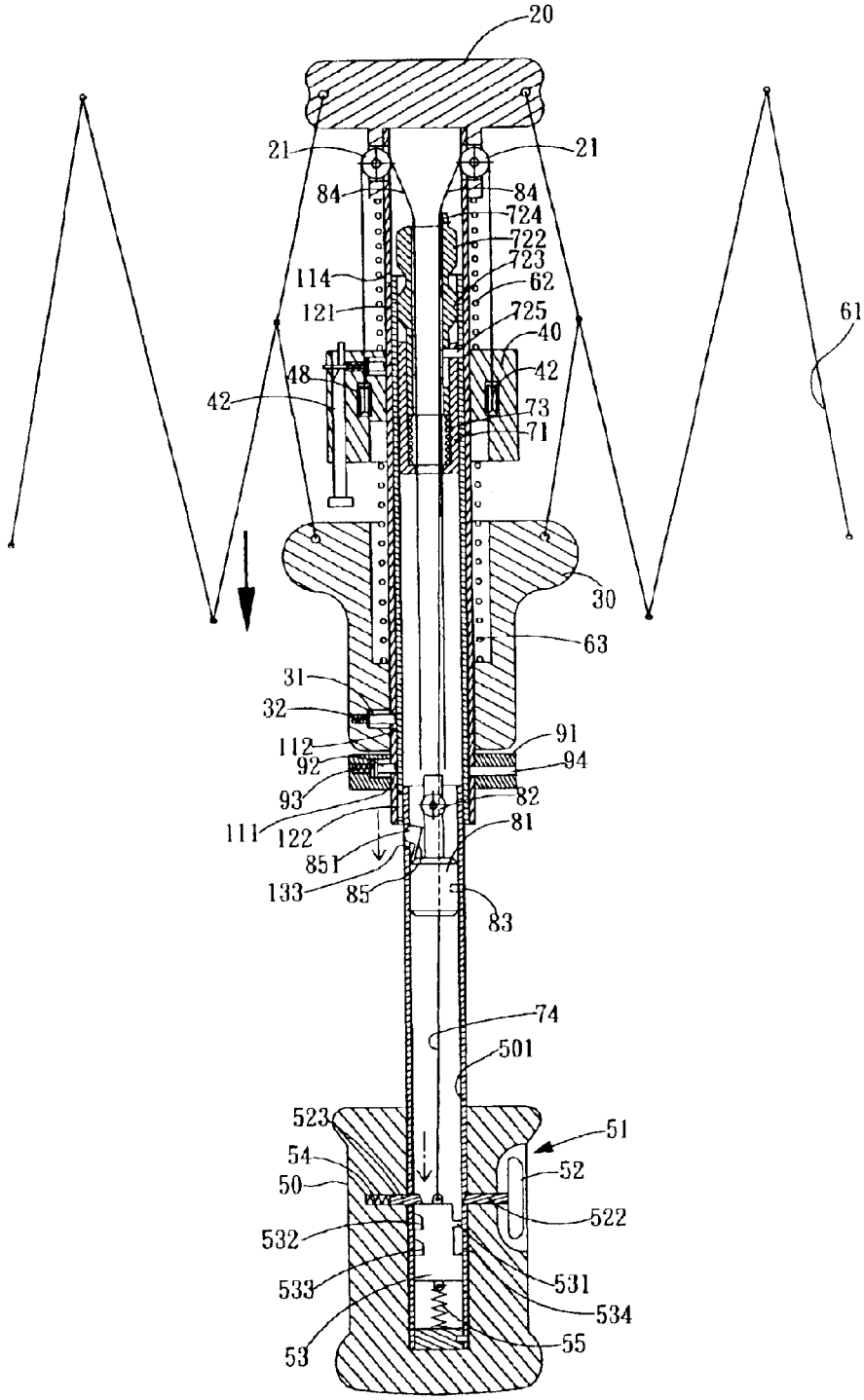
FIG. 9 is a schematic view showing the shafts retracted in as the runner and pull-ring descend.

Referring to FIG. 9, when the upper shaft 11 descends to be flushed with a lower end of the middle shaft 12, the bead 851 of the buckle 80 is extruded inward to separate from the though hole 122 so that the middle shaft 12 and lower shaft 13 are released from one another. Therefore, the upper shaft 11 and middle shaft 12 descend to be flushed with the lower shaft 13. Finally, a folding condition as shown in the FIG. 6 is achieved. The bones 61 and umbrella cloth are folded for storage without any manual operation.

By the present invention, the user can control the umbrella by only one hand so that the user can use the umbrella easily and conveniently. Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An automatic folding umbrella comprising a set of telescopic shafts including an upper shaft, a middle shaft and a lower shaft, a notch fixed at a top of the upper shaft, a runner movable along an upper shaft, a pull ring installed on the upper shaft and installed between the notch and the runner, a handle including a control device within, fixed at a lower end of the lower shaft, a plurality of ribs and stretchers connecting the notch and the runner, expandable springs installed between the notch and the pull ring, expandable springs installed between the pull ring and runner, at least one first buckle installed between two shafts, characterized in that:

a push and brake device installed at an upper end of the middle shaft, the push and brake device includes a sleeve in the middle shaft, a push rod in the sleeve, the push rod has an upper tapered and a lower tapered head, an expandable spring in the sleeve for ejecting the push rod, a pull line installed between the push rod and a break block of the control device, a second buckle is installed at the lower end of the upper shaft, a buckle stud and an expandable spring in an inner hole of the buckle ring, where as after the buckle stud passes through holes of the upper shaft, middle shaft, and then insert into a guide groove in the push rod between a upper tapered head and a lower tapered head.

2. The automatic folding umbrella construction as claimed in above claim 1, wherein an inner hole at the lower end of the runner has a buckle stud and an expandable spring, the buckle stud is inserted into a through hole of the upper shaft to resist against a top end of the upper tapered head of the push rod.

3. The automatic folding umbrella as claimed in claim 1, wherein the push rod is a round tube with an upper tapered head and a lower tapered head, diameters of the upper tapered head and lower tapered head are larger than that of the sleeves; at a upper tapered head is a protruding block to fix the pull line.

4. The automatic folding umbrella as claimed in claim 1, wherein a wall of the push rod is formed with a slot, the slot is aligned with the through holes of the wall of the sleeve and middle shaft, an inserting stud inserts into the through hole of the sleeve and the middle shaft for fixing the sleeve to the middle shaft, the stud is further inserted into the slot of the push rod so that the displacement of the push rod is confined by the stud.

5. An automatic folding umbrella comprising:

a set of telescopic shafts including an upper shaft, a middle shaft and a lower shaft, a notch fixed at a top of the upper shaft, a runner movable along the upper shaft, a pull ring installed on the upper shaft, in between the notch and runner, a handle including a control device fixed at the lower end of the lower shaft, a plurality of ribs and stretchers connecting the notch and runner, a plurality of expandable springs installed between the notch and the pull ring, a plurality of springs installed between the pull ring and runner, a first buckle connecting the upper shaft and the middle shaft and a second buckle connecting the middle shaft and the lower shaft;

wherein the second buckle for connecting the middle shaft and the lower shaft includes a post stud installed in the lower shaft, and a pulley installed on a post rod at an upper end of the post stud, an inserting stud for fixing the post stud to the lower shaft, and an elastic buckle piece installed at a wall of the post stud, the inserting stud passes through a hole in the lower shaft, and then is inserted into an embedded hole of the post stud, the pulley is a turning point of the pull line, and the elastic buckling piece has a bead, the bead is buckled into the holes of the middle shaft and lower shaft.

6. The automatic folding umbrella as claimed in claim 5 wherein a lower end of the elastic buckle piece is inserted into an inserting opening of the post stud and the bead is formed at an upper end of the elastic buckle piece.

7. The automatic folding umbrella as claimed in claim 5, wherein two ends of the pull line are formed as two lines after the pull line passes through the pulley, upper ends of the pull lines pass through the pulleys at a left and right top end of the upper shaft, and then the pull lines are guided into the pull ring to wind around the two winding wheels in the pull ring.

8. The automatic folding umbrella as claimed in claim 5, wherein an inner lateral wall of the pull ring is formed with a through hole for receiving the buckle stud and the expandable spring, a rear end of the buckle stud is combined with an inserting rod, an outer lateral wall of the pull ring is installed with an inserting opening, the inserting rod inserts into an inserting opening, the inserting opening is communicated with the hole, another axial hole is communicated with the radial inserting opening, the axial hole is inserted by a passing rod from an upper side thereof, a top of this passing rod has a wedge surface and a thin rod, the thin rod is insert into an annular opening of the inserting rod.

* * * * *